US007492269B2

(12) United States Patent
Matteson et al.

(10) Patent No.: US 7,492,269 B2
(45) Date of Patent: Feb. 17, 2009

(54) SELF DIAGONOSTIC FLAME IGNITOR

(75) Inventors: David J. Matteson, Avon, CT (US); Michel J. Sequin, Orleans (CA); Rebecca L. Tobiasz, Suffield, CT (US); James P. Sutton, South Windsor, CT (US)

(73) Assignee: ALSTOM Technology Ltd, Baden (CH)

( * ) Notice: Subject to any disclaimer, the term of this patent is extended or adjusted under 35 U.S.C. 154(b) by 925 days.

(21) Appl. No.: 11/063,601

(22) Filed: Feb. 24, 2005

(65) Prior Publication Data

US 2006/0199122 A1 Sep. 7, 2006

(51) Int. Cl.
*G08B 17/12* (2006.01)

(52) U.S. Cl. ..... 340/579; 340/577; 340/578; 340/635; 340/640; 431/75; 431/69

(58) Field of Classification Search ..... 340/577–579, 340/635, 657; 431/75, 69
See application file for complete search history.

(56) References Cited

U.S. PATENT DOCUMENTS

| | | | | | |
|---|---|---|---|---|---|
| 3,123,027 | A | | 3/1964 | Livingston | |
| 3,576,556 | A | * | 4/1971 | Sellors, Jr. | 340/579 |
| 3,740,574 | A | * | 6/1973 | Taylor | 307/117 |
| 4,107,657 | A | * | 8/1978 | Nishigaki et al. | 340/579 |
| 4,295,129 | A | | 10/1981 | Cade | |
| 4,404,616 | A | * | 9/1983 | Miyanaka et al. | 361/253 |
| 4,457,692 | A | * | 7/1984 | Erdman | 431/19 |
| 4,527,125 | A | * | 7/1985 | Miyanaka et al. | 307/653 |
| 4,672,324 | A | * | 6/1987 | van Kampen | 307/653 |
| 5,073,104 | A | * | 12/1991 | Kemlo | 431/12 |
| 5,307,050 | A | | 4/1994 | Patton et al. | |
| 5,329,273 | A | | 7/1994 | Patton | |
| 5,506,569 | A | * | 4/1996 | Rowlette | 340/577 |
| 5,549,469 | A | | 8/1996 | Wild et al. | |
| 5,902,099 | A | * | 5/1999 | Rowlette et al. | 431/22 |
| 5,938,424 | A | * | 8/1999 | Kurogi et al. | 431/13 |
| 6,356,199 | B1 | * | 3/2002 | Niziolek et al. | 340/579 |
| 6,443,728 | B1 | | 9/2002 | Edberg et al. | |
| 6,582,220 | B2 | | 6/2003 | Heck et al. | |
| 6,676,404 | B2 | * | 1/2004 | Lochschmied | 431/75 |
| 6,887,069 | B1 | * | 5/2005 | Thornton et al. | 431/12 |
| 7,289,032 | B2 | * | 10/2007 | Seguin et al. | 340/578 |

FOREIGN PATENT DOCUMENTS

| | | |
|---|---|---|
| EP | 1571395 | 9/2005 |

* cited by examiner

*Primary Examiner*—Daniel Wu
*Assistant Examiner*—Son M Tang
(74) *Attorney, Agent, or Firm*—Antonelli, Terry, Stout & Kraus, LLP.

(57) ABSTRACT

Techniques for monitoring operation of a flame ignitor are provided. In one embodiment, multiple inputs are received. The inputs are received from at least one of a first group of inputs and a second group of inputs. The first group includes a flame rod voltage, a stop signal for deactivation of the flame ignitor, a fuel supply interruption signal, and an air supply interruption signal. The second group includes a start signal for activation of the flame ignitor, and a flame proven signal indicating presence of a flame produced by the flame ignitor. If inputs from the first group are received, a cause of a failure of the flame ignitor is determined. If inputs from the second group are received, a reliability of the flame ignitor is determined.

20 Claims, 3 Drawing Sheets

SELF DIAGONOSTIC FLAME IGNITOR

FIELD OF THE INVENTION

The present invention relates to an ignitor for a fossil fuel fired combustion chamber, and more particularly to an ignitor having improved performance and reliability.

BACKGROUND OF THE INVENTION

In order to begin the combustion process inside a fossil fuel fired combustion chamber, such as that found in industrial and utility boilers, there must be an energy source to begin the self-sustaining combustion reaction of main fuel and air inside the combustion chamber. Current practice is to use a light fuel oil, natural gas, or propane ignitor of a size between input of 0.5 to 20 Million Btu/hr for each of several fuel admission compartments of the combustion chamber.

Ignitors have a dedicated fuel and air supply and an energy source, typically a spark plug, to produce a flame. In operation, fuel and air are introduced to the ignitor and a spark provides the energy to begin a self-sustaining reaction that keeps the ignitor burning. Proof that the ignitor is operating is established through the use of a flame detector, such as a flame rod, a thermal sensing device, or an optical sensor, that is often integral with the ignitor.

Once the ignitor is proven to be operating, main fuel and air for the combustion chamber can be introduced, often after utilizing the ignitor to preheat the combustion chamber. The energy from the ignitor (the ignitor flame), allows the combustion reaction of the main fuel and air to begin. Generally, once the main fuel and air is ignited the combustion reaction is self-sustaining, and the ignitor can be turned off. However, in some cases, such as due to low volatility of the main fuel, it is necessary to leave the ignitor on in order to keep the main combustion reaction continuing. In other cases, ignitors are left to burn continuously, as may be required by safety laws.

For reasons of safety it is important that the ignitor reliably begin burning on command, and that it be able to be confirmed that the ignitor is producing a flame to insure the safe combustion of the main fuel and air. Failure of an ignitor can result in unsafe accumulations of unburned main fuel and air, resulting in massive explosive damage.

In one known type of coal-fired boiler unit, one or more relatively high-capacity oil burners (warm-up guns) are started by one or more oil- or gas-fired ignitors to preheat the combustion chamber. Once the combustion chamber has been brought up to the proper starting temperature, coal nozzles are ignited by the oil- or gas-fired ignitors, or by the warm-up guns themselves.

At higher boiler loads, i.e., when the amount of coal supplied by the coal nozzles is great, the combustion chamber can typically maintain stable combustion of the pulverized coal. However, when the load goes down and the coal supply is thereby decreased, the stability of the pulverized coal flame is also decreased, and it is therefore common practice to use the ignitors or warm-up guns to maintain flame in the combustion chamber, thus avoiding the accumulation of unburned coal dust in the combustion chamber and the associated danger of explosion.

Certain portions of an ignitor mounted in a windbox compartment of a combustion chamber are subjected to relatively high temperatures, typically on the order of 500 degrees Fahrenheit or higher. In some conventional ignitors, there is a risk that an ignitor wire supplying energy to an ignitor spark element may burn up due to the high temperatures, especially when insufficient cooling air is supplied to the ignitor.

Recently, a gas-fired ignitor overcoming this problem has been proposed. However, oil-fired ignitors are still subject to this problem. Accordingly, a need exists for an oil-fired ignitor which provides a reliable spark action and which has improved survivability in a high temperature environment.

An ignitor's spray of fuel and air (the combustive mix) is produced by an atomizer. The spray produced by conventional atomizers used in oil-fired ignitors frequently has too many large droplets, resulting in insufficient oxygen at the base of the flame. An insufficient amount of oxygen results in excessive smoke formation, resulting in an unacceptable opacity from the stack. Accordingly, a need exists for an oil-fired ignitor that produces a spray with more available oxygen at the flame base.

Introduced above, conventional ignitors, no matter the type of ignitor fuel utilized, include some sort of flame sensing device which may be mechanical or optical. The output of such a flame sensing device is transmitted to a control room where operational decisions are made based upon the sensed flame. If no ignitor flame is detected when one is expected to be present, repair personnel must service the non-performing ignitor based upon only the information that a flame is not present. Lack of a flame could be due to any one of a faulty ignitor fuel supply, a faulty ignitor compressed air, or a faulty ignitor spark source. Further, a flame could actually be present, and the flame detector itself could be sending a false lack of flame signal. Currently, there is no way for service personnel to know what ignitor component has failed without physically examining that ignitor. Thus, many man-hours are spent attempting to determine the reason an ignitor has failed. If repair personnel had an indication of a reason for failure prior to beginning a repair operation, many of those man-hours could be saved. Accordingly, a need exists for an ignitor which provides information indicating which component has failed.

Aside from an ignitor failure, routine scheduled maintenance of ignitors is typically performed in an effort to prevent failure. A single utility boiler typically can include upwards of 64 individual ignitors that must be maintained. Performing this routine maintenance is both costly and time consuming. That is, each ignitor, whether functioning properly or not, is regularly inspected. If those ignitors that required service could be identified, not only could the time and cost expenses of services all ignitors be saved, but costs associated with ignitor failure, such as boiler down time, could be saved. Accordingly, a need exists for an ignitor in which the necessity of service can be determined prior to failure.

OBJECTS OF THE INVENTION

It is an object of the present invention to provide an oil-fired ignitor having reliable spark action in a high temperature environment.

It is another object of the present invention to provide an oil-fired ignitor having an improved atomizer.

Another object of the present invention is to provide an ignitor having higher reliability than conventional ignitors.

Still another object of the present invention is to provide an ignitor in which an indication of which component, or components, are responsible for an ignitor failure is available.

Yet another object of the present invention is to provide an ignitor in which the necessity of service can be determined prior to an ignitor failure.

The above-stated objects, as well as other objects, features, and advantages, of the present invention will become readily apparent from the following detailed description which is to be read in conjunction with the appended drawings.

SUMMARY OF THE INVENTION

Methods and systems for monitoring operation of a flame ignitor are provided herein. The flame ignitor is used to begin and/or support the combustion process inside a fossil fuel fired combustion chamber. A system includes at least a memory and a processor. A processor can be any type of processor capable of functioning to implement the techniques described herein. A memory can be any type of memory capable of storing information and communicating with a processor.

In a first embodiment of the present invention, multiple inputs from at least one of a first group of inputs and a second group of inputs are received. That is, the multiple inputs could all come from the first group, could all come from the second group, or come from a mixture of the first and second groups.

The first group of inputs includes a flame rod voltage, a stop signal for deactivation of the flame ignitor, a fuel supply interruption signal, and an air supply interruption signal. A flame rod voltage measures the intensity of flame, with the voltage being proportional to the intensity of the flame. A stop signal causes the flame ignitor to cease operation. A fuel supply interruption signal indicates that the fuel supply for the flame ignitor has been interrupted, and an air supply interruption signal indicates that the air supply for the flame ignitor has been interrupted. The second group of inputs includes a start signal for activation of the flame ignitor and a flame proven signal indicating presence of a flame produced by the flame ignitor. A start signal causes the flame ignitor to begin operation. A flame proven signal indicates that the ignitor is successfully operating, i.e., producing a flame.

If inputs from the first group are received, a determination of a cause of a failure of the flame ignitor is made. This determination is made based upon the received inputs from the first group. If inputs from the second group are received, a determination of the reliability of the flame ignitor is made. This reliability determination is made based upon the received inputs from the second group. It should be understood that inputs from both groups may be received.

In one aspect of this first embodiment, information associated with one or more determinations made based upon the received inputs is transmitted. This could include a single transmission, or multiple transmissions. Further, a transmission could be, as desired, made to a single entity, or multiple entities. Also, a transmission could be a scheduled transmission, could be made whenever a determination is made, or could be made ad hoc.

In a further aspect, the information associated with a determination is transmitted to at least one of a control room associated with a combustion chamber with which the flame ignitor is associated, and a location remote from the control room. In an even further aspect, the remote location is associated with an entity responsible for servicing the flame ignitor. The responsible entity could be an entity other than the entity to which the combustion chamber belongs.

In another aspect of this first embodiment, multiple start signals and multiple flame proven signals are received. Each received input is stored. The number of stored flame proven signals is divided by the number of stored start signals to determine the reliability of the flame ignitor.

In a further aspect, a warning signal is transmitted when the determined reliability violates a reliability set-point. That is, if the determined reliability does not meet a predetermined criteria, a warning signal is transmitted. This transmission could be to the control room, could be to a remote location, could be to another location, or could be to multiple locations.

According to still another aspect of this embodiment, multiple inputs from group one are received. An indication of each received input from group one is stored. This indication identifies the particular type of group one input received. Also, a time that each group one input is received is stored. The cause of failure is determined based, at least in part, upon the stored time information. In a further aspect, the cause of failure is determined based upon the first received group one input.

In yet another aspect of the first embodiment, information associated with one or more determinations is outputted via a display on the flame ignitor. That is, the flame ignitor has a display that is configured to show information associated with at least one determination that has been made based upon the multiple received inputs. This information could be related to one, or both of, a cause of failure of the flame ignitor and a reliability of the flame ignitor.

According to a second embodiment for monitoring operation of a flame scanner, multiple inputs that are each associated with operation of the flame scanner are received. An operational parameter of the flame ignitor is then determined based upon one or more of the received inputs. In one aspect of this second embodiment, the determined operational parameter is one of a cause of a failure of the flame ignitor, and a reliability of the flame ignitor.

In another aspect of the flame ignitor, each input is one of a flame rod voltage, a stop signal for deactivation of the flame ignitor, a fuel supply interruption signal, an air supply interruption signal, a start signal for activation of the flame ignitor, and a flame proven signal, each discussed above.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF PREFERRED EMBODIMENT(S)

Figure 1:
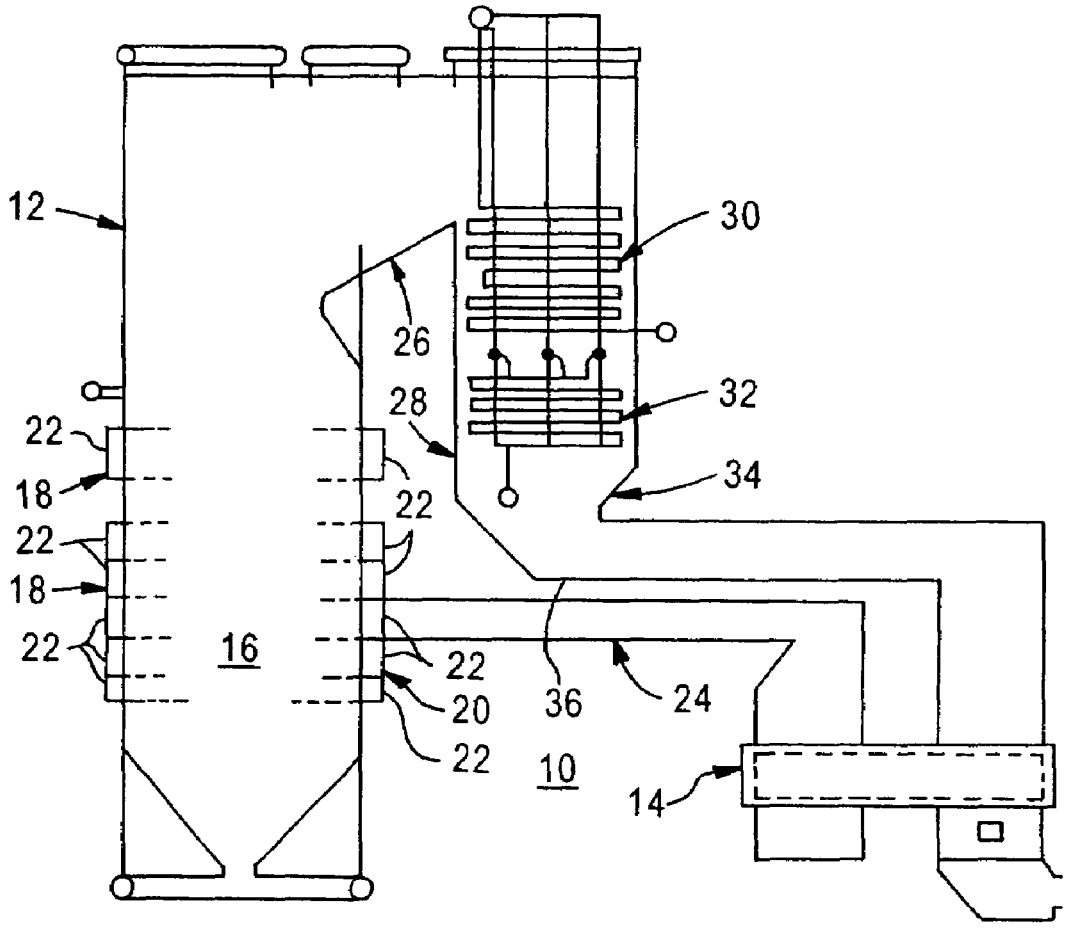
FIG. 1 a schematic plan view of a fossil fuel-fired furnace having a preferred embodiment of the ignitor of the present invention installed thereon.

Referring now to the drawings, and more particularly to FIG. 1, there is depicted a conventional fossil fuel-fired power generation system, generally designated by the reference numeral 10, having installed therein a preferred embodiment of the ignitor of the present invention. It should be understood that the ignitor of the present invention could be utilized in industrial or utility installations other than that depicted in FIG. 1. The fossil fuel-fired power generation system 10 includes a fossil fuel-fired steam generator 12 and an air preheater 14.

The fossil fuel-fired steam generator 12 includes a burner region. It is within the burner region 16 of the fossil fuel-fired steam generator 12 that the combustion of fossil fuel and air, in a manner well-known to those skilled in this art, is initiated. To this end, the fossil fuel-fired steam generator 12 is provided with a conventional firing system 18.

The firing system 18 includes a housing, preferably in the form of a windbox 20. The windbox 20 includes a plurality of compartments, each designated 22. In conventional fashion, some of the compartments 22 are designed to function as fuel compartments from which fossil fuel is injected into the burner region 16, while others of the compartments 22 are designed to function as air compartments from which air is injected into the burner region 16. The fossil fuel is supplied to the windbox 20 by a conventional fuel supply means, not shown in the interest of maintaining clarity of illustration in the drawing. At least some of the air which is injected into the burner region 16 for purposes of effecting combustion of the injected fuel is supplied to the windbox 20 from the air preheater 14 through the duct 24.

It is within the burner region 16 of the fossil fuel-fired steam generator 12 that the combustion of the fossil fuel and air is initiated. The hot gases that are produced from this combustion of the fossil fuel and air rise upwardly in the fossil fuel-fired steam generator 12. During the upwardly movement thereof in the fossil fuel-fired steam generator 12, the hot gases, in a manner well-known to those skilled in this art, give up heat to fluid flowing through tubes (not shown in the interest of maintaining clarity of illustration in the drawing) that in conventional fashion line all four of the walls of the fossil fuel-fired steam generator 12. Then, the hot gases flow through the horizontal pass 26 of the fossil fuel-fired steam generator 12, which in turn leads to the rear gas pass 28 of the fossil fuel-fired steam generator 12. Although not shown in FIG. 1, it should be understood that the horizontal pass 26 would commonly have suitably provided therein some form of a heat transfer surface. Similarly, heat transfer surface, as illustrated at 30 and 32, is suitably provided within the gas pass 28. During passage through the rear gas pass 28 the hot gases give up heat to the fluid flowing through the tubes of the heat transfer surface.

Upon exiting from the rear gas pass 28 of the fossil fuel-fired steam generator 12 the hot gases are conveyed to the air preheater 14. To this end, the fossil fuel-fired steam generator 12 is connected from the exit end 34 thereof to the air preheater 14 by means of duct work 36. After passage through the air preheater 14, the now relatively cooler hot gases are further conducted to conventional treatment apparatus which are not illustrated in the interest of clarity.

Figure 2:
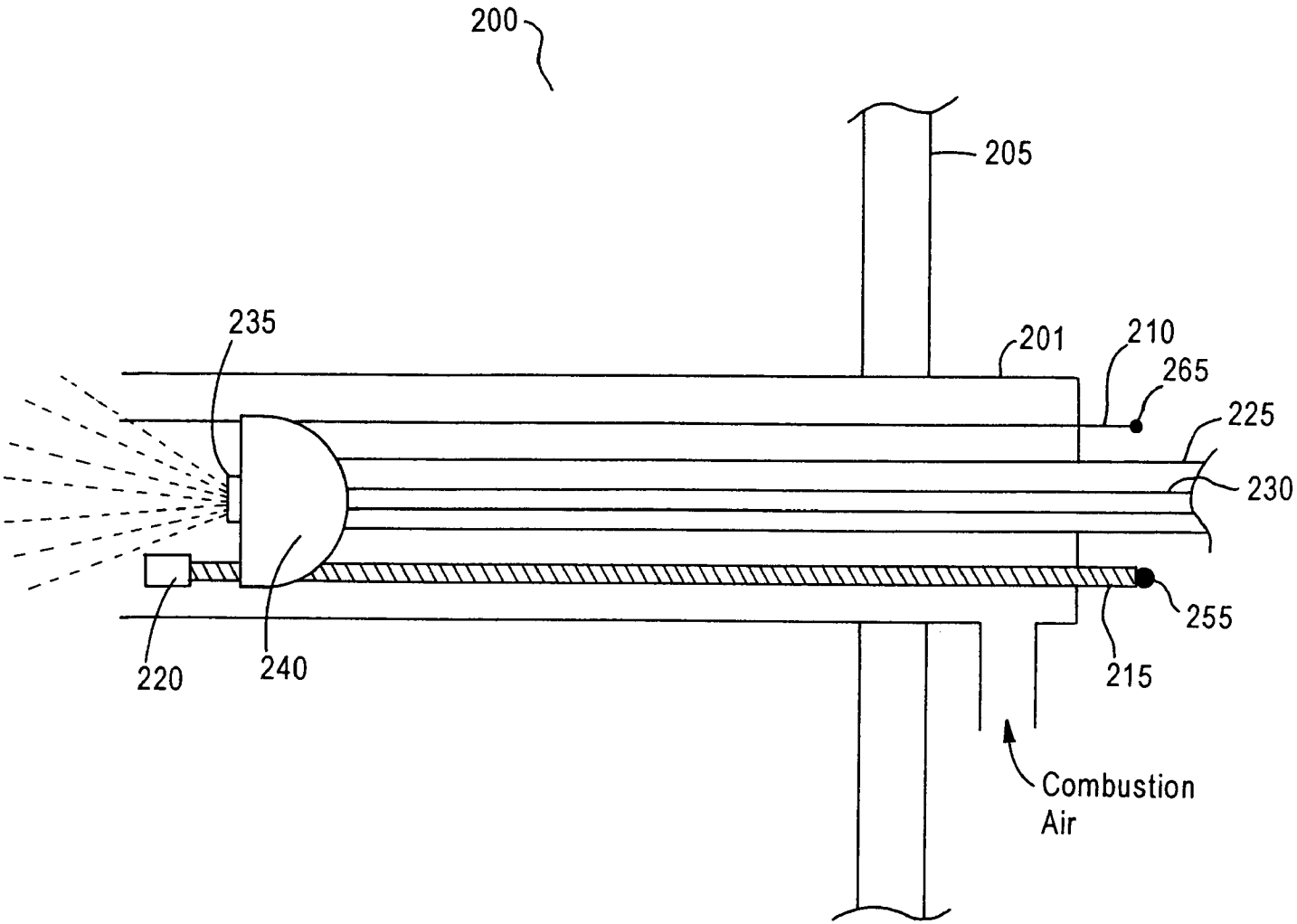
FIG. 2 is a simplified depiction of an oil-fired ignitor in accordance with one aspect of the present invention.

The fossil fuel-fired steam generator 12 is provided with a preferred embodiment of the ignitor of the present invention. FIG. 2 shows an oil-fired ignitor 200 mounted in one of the windboxes of the fossil fuel-fired steam generator 12. It should be understood that the fossil fuel-fired steam generator 12, as well as any other industrial or utility installation, can be provided with any desired number of the ignitor of the present invention. The ignitor 200 is mounted inside a pipe 201 secured to a windbox wall 205. The ignitor 200 includes a conventional flame rod 210, a spark extension assembly 215, a compressed air conduit 225, a fuel conduit 230 collinear and disposed within the compressed air conduit 225, a bluff body 240 disposed at the terminus of the compressed air conduit 225, and an atomizer 235 disposed within the bluff body 240.

The spark extension assembly 215 includes a solid conductor with an outer ceramic insulation coating, enabling the spark extension assembly 215 to survive temperatures greater than 1000 degrees Fahrenheit. The solid conductor, preferably made of stainless steel, though it could be any other conductive metal, connects to an external electrical power source (not shown in the Figures) at terminus 255. At the opposite end of the spark extension assembly 215 is a high energy ignitor tip 220. The solid conductor receives electrical current from the power source and conducts the electrical current to the high energy ignitor tip 220, which produces a spark to ignite a spray mixture of the compressed air and fuel released by the atomizer 235. U.S. Pat. No. 6,582,220, assigned to the assignee of the present invention and which is incorporated herein in its entirety, discloses an elongate electrode assembly suitable for use as the spark extension assembly 215.

The external power source provides a high energy pulse of electricity to the spark extension assembly 215. Preferably, the pulse is 12 joules for a microsecond pulse period, though other high energy levels and/or pulse periods could be provided by the external power supply. Because of the high energy pulse, any unburned fuel and combustion products that have accumulated on the high energy ignitor tip 220 are removed by the resultant spark. Thus, degradation of the performance of the spark extension assembly 215 due to build up is prevented.

The spark from the high energy ignitor tip 220 is positioned in the output spray of the atomizer 235. The spark ignites the compressed air/fuel spray produced by the atomizer 235. The configuration of the atomizer 235 allows additional compressed air to come straight out of the center of the atomizer 235 into the central core of the spray to improve the fuel to air ratio. This feature results in an increased amount of oxygen at the flame base, which reduces opacity.

The bluff body 240 is spherical, or essentially spherical, with a truncated face. The spherical shape minimizes air flow friction losses and permits substantially greater mass flow of air through the pipe 201, which in turn allows proper fuel mixing for a greater amount of fuel for combustion. U.S. Pat. No. 6,443,728, assigned to the assignee of the present invention and which is incorporated herein in its entirety, discloses a structure suitable for use as the bluff body 240.

In operation, the flame rod 210 is charged to approximately 40 volts DC, allowing for an optimum signal-to-noise ratio. As flame ions interact with the flame rod 210, the voltage dips and rises. These voltage fluctuations are measured by sensor 265. The measured voltage is transmitted to processing electronics, to be discussed below.

Figure 3:
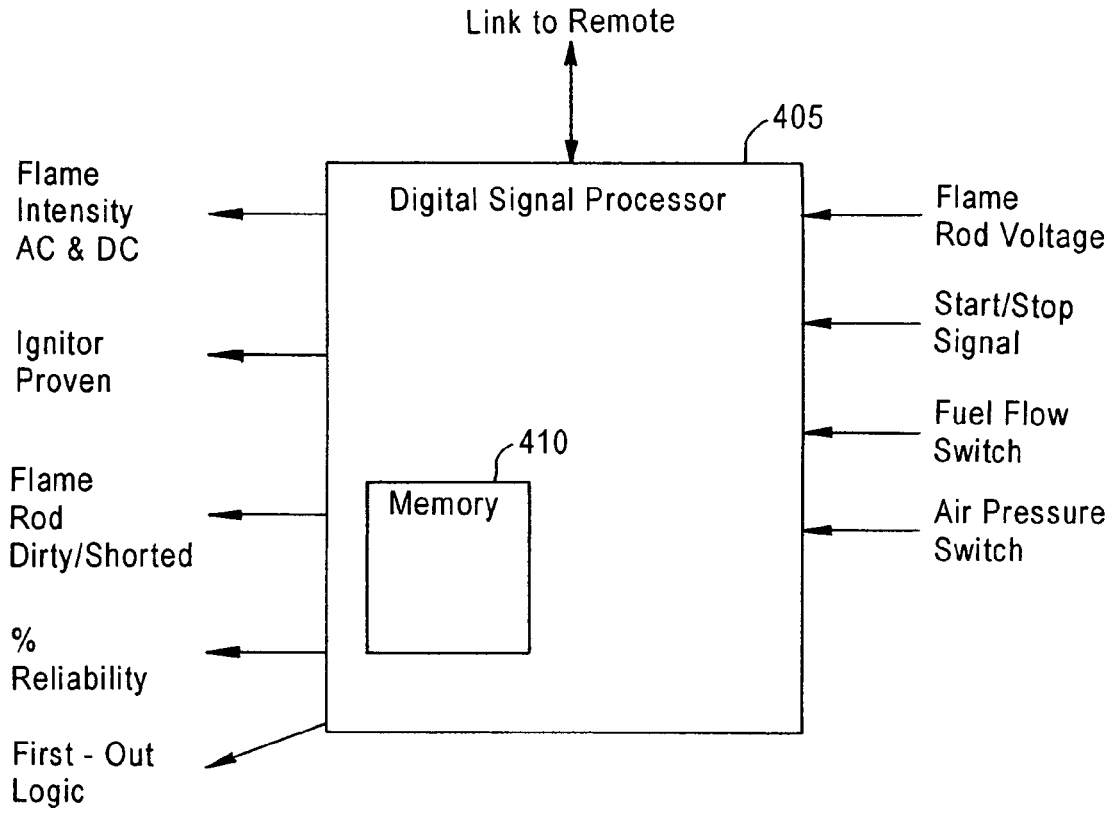
FIG. 3 is a simplified depiction of processing electronics in accordance with certain aspects of the present invention for use with an ignitor.

With reference to FIG. 3, the processing electronics 400, which can, as desired, be housed proximate to or remote from the ignitor 200, include a digital signal processor 405 and a memory 410. The digital signal processor 405 communicates with the memory 410. As desired, and as shown in FIG. 3, the digital signal processor 405 and the memory 410 may be combined into a single unit. The digital signal processor 405 is preferably of a minimum specification of 16-bit design operating at 40 million instructions per second, however other designs could be utilized, as desired. It should be understood that the control electronics shown in FIG. 3 and described below can be utilized with ignitors burning any type fuel, not just the oil-fired ignitor 200 shown in FIG. 2.

The digital signal processor 405 includes multiple inputs for receiving information and multiple outputs for communicating the received information and determined information to operators and service technicians. The inputs include the flame rod voltage sensed by sensor 265 discussed above, a start/stop signal input, a fuel flow switch input, and an air pressure switch input. The start/stop signal input is associated with signals generated in the control room indicating a desire to activate or deactivate the ignitor 200. That is, whenever an operator attempts to start the ignitor 200, a start signal is received at the digital signal processor 405, and whenever an operator stops the ignitor 200, a stop signal is received at the digital signal processor 405. Indications of these start and stop signals are stored in the memory 410 by the digital signal processor 405, along with a time each was received. These stored indications will be further discussed below.

The fuel flow switch input receives signals from a fuel line sensor (not shown in the Figures) on a fuel line to the ignitor 200. Whenever fuel flow is interrupted, or decreases below a certain level, the fuel line sensor sends a fuel flow warning signal to the digital signal processor 405. A fuel flow warning signal causes a trip of the ignitor 200. In a trip, as well as in an operator-ordered shut down, the ignitor's fuel, air, and spark are discontinued, causing the ignitor flame to extinguish. The digital signal processor 405 stores an indication of the fuel flow warning signal in the memory 410, along with the time such was received.

The air pressure switch input receives signals from a compressed air line sensor (not shown in the Figures) on a compressed air line to the ignitor 200. Whenever compressed air flow is interrupted, or decreases below a certain level, the compressed air line sensor sends a air flow warning signal to the digital signal processor 405. An air flow warning signal also causes a trip of the ignitor 200. The digital signal processor 405 stores an indication of the air flow warning signal in the memory 410, along with the time such was received.

The memory also stores trip set points associated with the sensed flame intensity on the flame rod 210. If the DC voltage measured by sensor 265 and input to the digital signal processor 405 violates a trip set point, the digital signal processor 405 trips the ignitor 200. The digital signal processor 405 also calculates an AC voltage based upon the input DC voltage from sensor 265. Likewise, if the calculated AC voltage violates a trip set point, the digital signal processor 405 trips the ignitor 200. Whenever the ignitor 200 is tripped due to violation of a set point, an indication of such, along with the time, is stored in the memory 410 by the digital signal processor 405.

Separate from the trip set point processing described above, the sensed DC voltage and the calculated AC voltage is available as a real-time output, shown as Flame Intensity AC & DC output. A related output is the Ignitor Proven output. This output is a state-based output. That is, if the sensed DC voltage and the calculated AC voltage do not violate a set point, a high signal is output. Whereas, if one or both of the AC and DC voltages violates a set point, a low signal is output. Outputs will be further discussed below.

Also based upon the sensed flame rod DC voltage and calculated flame rod AC voltage is the Flame Rod Dirty/Shorted output. This output is also a state-based output. If the flame rod 210 is operating properly, the Flame Rod Dirty/Shorted output will be high. However, if the sensed DC voltage falls to zero, or another stored value that indicates a shorted flame rod, the Flame Rod Dirty/Shorted output will be low. Also, the digital signal processor 405 monitors the calculated AC voltage. Stored in the memory 410 is an indication of an expected AC voltage waveform. If the calculated AC voltage does not match the expected AC voltage waveform, or deviates from the expected AC voltage waveform more than an acceptable amount, the Flame Rod Dirty/Shorted output will be low.

The stored information based upon the received inputs discussed above forms a first-out logic architecture. The first-out architecture aids in determining why an operating ignitor has failed. Whenever an ignitor trips, no matter the cause, signals indicating improper fuel flow, improper air flow, and improper voltage, as discussed above, will each be received. This is because once an ignitor shuts down, fuel and air flow cease, causing the flame to extinguish, which in turn causes the flame rod to detect a lack of a flame. Because of stored time information associated with each of these variables, the cause of the trip can easily be determined. It should be understood that the stored time information could simply be ordering information, or could be an actual time. As an example of the first-out logic, if the ignitor 200 trips because of the an improper fuel flow, the stored indication of improper fuel flow will have the earliest time indication because the improper air flow signal and the lack of voltage signal will be received subsequent to the improper fuel flow signal. The digital signal processor 405 is programmed to determine which of the stored signals associated with a particular failure was received first and output this determination to an operator or service technician via the First-Out Logic output.

Introduced above, an indication of each received start signal is stored in memory 410. Also stored in memory 410 is an indication of each actual start. Each time the digital signal processor 405 determines that the flame rod detects a flame within a certain time period following receipt of a start signal the digital signal processor 405 stores an indication of a successful start in the memory 410. The number of received start signals and the number of successful starts is the basis for determining reliability of the ignitor. Thus, the digital signal processor 405 divides the number of successful starts indicated in the memory 410 by the number of received start signals indicated in the memory 410 to produce a percentage reliability indication. This information is available via the % Reliability output.

The percentage reliability indication is especially useful in determining degradation of the spark extension assembly 215, as this component is most often associated with a failed start attempt. The digital signal processor 405 is programmed to not only calculate the percentage reliability, but also report a need for service based upon that information. As desired, the digital signal processor 405 can be programmed to transmit a service request when the calculated percentage reliability falls below a certain set point, stored in memory 410. Alternatively, or perhaps in combination, the digital signal processor 405 can be programmed to transmit a service request when the calculated percentage reliability begins to trend downward, perhaps even at a predetermined rate stored in the memory 410. A service request is transmitted via a Link to Remote, to be discussed further below.

The digital signal processor 405 has a user interface through which all outputs discussed above are available. The user interface includes a backlit LED bargraph display for communicating each output. Thus, via the display, an operator or service technician can view the DC and the AC flame intensity and the percent reliability, as well as the Ignitor Proven and Flame Rod Dirty/Shorted outputs. Especially beneficial, the digital signal processor-determined cause of a trip is also available via the display. Also, the user interface includes a user input, preferably password protected, through which an operator or service technician can adjust the stored voltage trip set points and the shorted voltage.

Also shown in FIG. 3 is the Link to Remote input/output. Through the Link to Remote, all outputs discussed above can be transmitted to a remote location, such as a local control room, or even a remote monitoring station. This feature is especially useful for providing the first-out logic determination to an operator or service technician, and for transmitting a service request. Also through the Link to Remote, any user inputs can be communicated to the digital signal processor 405.

The Link to Remote output can be, as desired, an Ethernet or serial connection. Specifically, Device Net, Industrial Ethernet, MODBUS or RS-232 communication protocols may be utilized. Beneficially, multiple digital signal processors 405, each associated with a single ignitor 200, can be serially connected, saving cabling costs.

The present invention is not to be limited in scope by the specific embodiments described herein. Indeed, various modifications of the present invention in addition to those described herein will be apparent to those of skill in the art from the foregoing description and accompanying drawings. Thus, such modifications are intended to fall within the scope of the appended claims.

We claim:

1. A method for monitoring operation of a flame ignitor including a flame rod for igniting a flame within a combustion chamber, comprising:

receiving one of (i) first input including a DC voltage of the flame rod, and (ii) second input including a plurality of start signals, each indicative of an operator instruction to activate the flame ignitor, and one or more flame proven signals, each indicative of a presence of a flame produced by the flame ignitor responsive to a respective one of the plurality of start signals;

if the first input is received, computing an AC voltage based upon the received first input, and determining if the flame rod is dirty based on the computed AC voltage; and if the second input is received, determining, based upon the received second input, a reliability of the flame ignitor.

2. The method of claim 1, wherein:

the computed AC voltage includes an AC voltage waveform; and the computed AC voltage waveform is compared with an expected AC voltage waveform to determine if the flame rod is dirty.

3. The method of claim 2, further comprising:

transmitting a signal indicative of the dirty flame rod to at least one of (i) a control room associated with the combustion chamber, and (ii) a location remote from the control room, if the flame rod is determined to be dirty.

4. The method of claim 3, wherein the remote location is associated with an entity responsible for servicing the flame ignitor.

5. The method of claim 1, wherein:

the reliability of the flame ignitor is determined by dividing the number of the received flame proven signals by the number of received start signals to compute a result, and comparing the result to a reliability set point.

6. The method of claim 5, further comprising:

transmitting a warning signal, if the ignitor is determined to be unreliable, to at least one of (i) a control room associated with the combustion chamber, and (ii) a location remote from the control room.

7. The method of claim 1, wherein the DC voltage is a first DC voltage and the first input also includes a second DC voltage of the flame rod, and further comprising:

receiving third input including a fuel supply interruption signal and fourth input including an air supply interruption signal; and determining a cause of a failure of the flame ignitor based upon a respective time at which each of the second DC voltage, fuel supply interruption signal and air supply interruption signal is received.

8. The method of claim 7, wherein the cause of the failure is determined based upon an earliest of the respective times.

9. The method of claim 1, further comprising:

displaying information indicative of the determination at the flame ignitor.

10. A system for monitoring operation of a flame ignitor including a flame rod for igniting a flame within a combustion chamber, comprising:

a memory configured to store one of (i) first input including a DC voltage of the flame rod, and (ii) second input including a plurality of start signals, each indicative of an operator instruction to activate the flame ignitor, and one or more flame proven signals, each indicative of a presence of a flame produced by the flame ignitor responsive to a respective one of the plurality of start signals; and a processor configured to(i), if the first input is received, compute an AC voltage based upon the stored first input, and determine if the flame rod is dirty based on the computed AC voltage, and(ii), if the second input is received, determine, based upon the stored second input, a reliability of the flame ignitor.

11. The system of claim 10, wherein:

the computed AC voltage includes an AC voltage waveform; and the computed AC voltage waveform is compared with an expected AC voltage waveform to determine if the flame rod is dirty.

12. The system of claim 11, wherein:

the processor is further configured to transmit a signal indicative of the dirty flame rod to at least one of (i) a control room associated with the combustion chamber, and (ii) a location remote from the control room, if the flame rod is determined to be dirty; and the remote location is associated with an entity responsible for servicing the flame ignitor.

13. The system of claim 10, wherein:

the memory is further configured to store a reliability setpoint; and the processor is further configured to divide the number of stored flame proven signals by the number of stored start signals to compute a result, and to determine the reliability of the flame ignitor by comparing the computed result to the stored reliability set point.

14. The system of claim 13, wherein:

the processor is further configured to transmit a warning signal, if the flame ignitor is determined to be unreliable, to at least one of (i) a control room associated with the combustion chamber, and (ii) a location remote from the control room.

15. The system of claim 10, wherein:

the DC voltage is a first DC voltage;

the stored first input includes a second DC voltage and a time associated with generation of the second DC voltage;

the memory is further configured to store a third input including a fuel supply interruption indicator and a time associated with generation of the fuel supply interruption indicator, and a fourth input including an air supply interruption indicator and a time associated with generation of the air supply interruption indicator; and the processor is further configured to determine a cause of a failure of the flame ignitor based upon the stored respective times associated with the generation of the second DC voltage, the fuel supply interruption indicator, and the air supply interruption indicator.

16. The system of claim 15, wherein the cause of the failure is determined based upon an earliest of the stored times.

17. The system of claim 10, further comprising:

a display disposed at the flame ignitor and configured to present information indicative of the determination.

18. A method for monitoring operation of a flame ignitor including a flame rod for igniting a flame within a combustion chamber, comprising:

receiving (i) first input including a DC voltage of the flame rod, and (ii) second input including a plurality of start signals, each indicative of an operator instruction to activate the flame ignitor, and one or more flame proven signals, each indicative of a presence of a flame produced by the flame ignitor responsive to a respective one of the plurality of start signals;

computing an AC voltage based upon the received first input, and determining if the flame rod is dirty based on the computed AC voltage; and determining, based upon the received second input, a reliability of the flame ignitor.

19. The method of claim 18, wherein:

the computed AC voltage includes an AC voltage waveform; and the computed AC voltage waveform is compared with an expected AC voltage waveform to determine if the flame rod is dirty.

20. The method of claim 18, wherein:

the reliability of the flame ignitor is determined by dividing the number of the received flame proven signals by the number of received start signals to compute a result, and comparing the result to a reliability set point.

* * * * *